United States Patent [19]

Southard

[11] 4,012,982

[45] Mar. 22, 1977

[54] PERCUSSION PROCESSOR FOR ELECTRONIC MUSICAL INSTRUMENT

[75] Inventor: James S. Southard, Union, Mich.

[73] Assignee: C.G. Conn, Ltd., Elkhart, Ind.

[22] Filed: Mar. 19, 1976

[21] Appl. No.: 668,617

Related U.S. Application Data

[63] Continuation of Ser. No. 562,174, March 26, 1975, abandoned.

[52] U.S. Cl. ..... 84/1.01; 84/1.24; 84/1.26; 84/DIG. 5; 84/DIG. 26; 179/1 J; 179/1 M; 333/29

[51] Int. Cl.[2] ..... G10H 1/00; G10H 5/00

[58] Field of Search ..... 84/1.01, 1.03, 1.13, 84/1.24, 1.26, DIG. 4, DIG. 5, DIG. 26; 333/29; 340/365 R, 365 S; 179/1 J, 1 M

[56] References Cited

UNITED STATES PATENTS

| | | | |
|---|---|---|---|
| 3,681,531 | 8/1972 | Burkhard et al. | 179/1 J |
| 3,816,637 | 6/1974 | Whitefield | 84/1.24 |
| 3,939,437 | 2/1976 | Adam | 84/DIG. 26 |

*Primary Examiner*—Stanley J. Witkowski
*Attorney, Agent, or Firm*—Drummond, Nelson & Ptak

[57] ABSTRACT

A percussion processor for an electronic musical instrument, such as an electronic organ in which information representative of the actuation of selected switches corresponding to associated notes of the musical scale is furnished in the form of a time-division multiplexed signal having repetitive sequences of time slots, includes a delay circuit comprising a shift register having a time delay period equal to the duration of one of the sequences of time slots or an integer multiple thereof. The multiplexed signal train is applied to the delay circuit and also is applied in parallel to an inverter circuit. The output of the inverter and the output of the shift register are connected to different inputs of a NAND gate. The output of this gate is a time-division multiplexed signal with pulses in time slots corresponding to the time slots of the multiplexed signal applied to the input of the shift register, but from which such pulses are deleted after one or more sequences depending upon the length of the delay circuit. This modified signal is applied to percussion or chiff keyers and simulates a pizzicato touch, irrespective of the manner in which the keyboard originally producing the information is played.

5 Claims, 2 Drawing Figures

PERCUSSION PROCESSOR FOR ELECTRONIC MUSICAL INSTRUMENT

This is a continuation of application Ser. No. 562,174 filed on Mar. 26, 1975, and now abandoned.

BACKGROUND OF THE INVENTION

Ordinarily, percussion processors for electronic musical instruments, such as electronic organs or the like, include parallel RC networks for supplying the keyers with a turn-on voltage which is applied only momentarily to simulate a pizzicato or percussion touch, even though the keyboards may be played with a legato technique. Such keyers include the keyers used for producing percussion effects as well as the chiff keyers used in conjunction with the flute keyers to produce the desired pipe organ sounds from the instrument. A parallel percussion processor of this type for producing the desired percussion effects for all of the different tones capable of reproduction by the percussion or chiff keyers requires a large number of resistors, capacitors, and complicated interconnecting wiring.

In an attempt to reduce the number of interconnecting wires between a keyboard and keyers of an electronic organ, time-division multiplex techniques have been developed to sequentially and repetitively scan the key switches and control switches to produce a single repetitive sequence of time-division multiplexed pulses on a single output lead for further processing by the keyers of the organ. While this substantially reduces the amount of wiring needed for producing ordinary tones in the organ, it still has been necessary to demultiplex this information and to drive a large number of parallel RC keyer circuits to produce percussion or chiff effects. This requires additional demultiplexing circuits with a large amount of interwiring and, of course, capacitors and resistors for each of the percussion note inputs to the percussion and chiff keyers.

It is desirable to utilize percussion processing in a time-division multiplexed electronic organ which eliminates the necessity for using RC circuits to produce percussion effects and which is capable of operating upon the serial time-division multiplexed signal to permit it to be used without first demultiplexing it to drive a conventional keyer to produce percussion and chiff effects.

SUMMARY OF THE INVENTION

Accordingly, it is an object of this invention to provide an improved electronic musical instrument.

It is an additional object of this invention to provide an improved percussion processor for an electronic musical instrument.

It is a further object of this invention to provide an improved percussion processor for a time-division multiplexed keying system in an electronic musical instrument.

It is another object of this invention to provide a percussion processor for a time-division multiplexed system in an electronic musical instrument which produces the desired percussion effects directly from the serial data stream of the time-division multiplexed signal.

It is yet another object of this invention to modify a time-division multiplexed signal in an electronic organ to a form which represents a pizzicato keying effect irrespective of the manner in which the keyer and control switches of the organ are operated to produce the original signal.

In accordance with a preferred embodiment of this invention, an electronic musical instrument, such as an electronic organ, has information representative of the actuation of selected key switches and control switches for associated notes of the musical scale furnished in the form of a time-division multiplexed signal, containing a cyclically repeating sequence of time slots associated respectively with the switches. A pulse in any given time slot is indicative of the actuation of the switch associated with that time slot. The time-division multiplexed signal is supplied in parallel to a delay circuit and an inverter circuit. The delay circuit comprising a shift register has a time delay period which is equal to an integral number of sequences of time slots of the original time-division multiplexed signal. The output of the delay circuit and the output of the inverter are supplied to first and second inputs, respectively, of a coincidence gate which operates to pass pulses in time slots of the signal appearing on its output only when no coincidence exists between the output of the inverter and the delayed pulse obtained from the output of the shift register. This effectively operates to delete pulses from the original time-division multiplexed signal when a legato note is played and reduces the apparent duration of the operation of the key switch producing that note to a time interval directly proportional to the length of the delay circuit.

DETAILED DESCRIPTION

Figure 1:
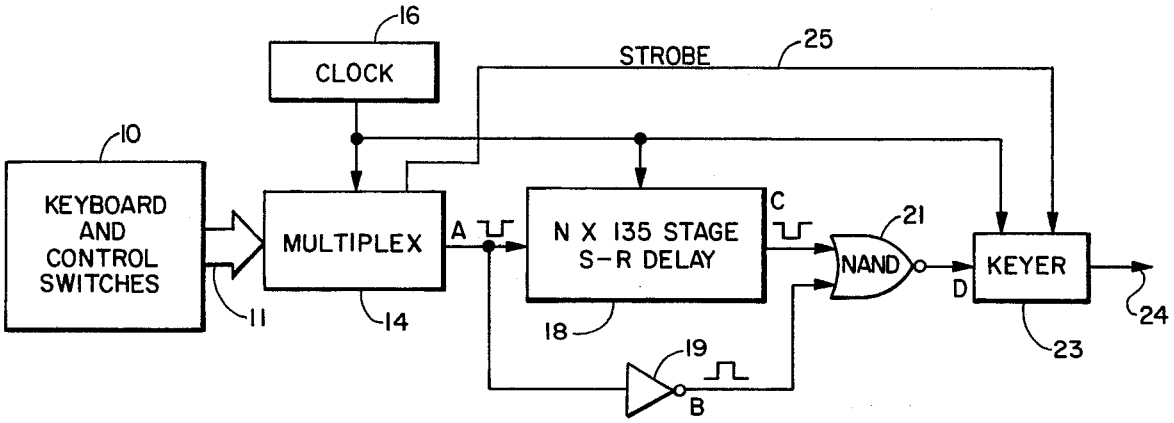
FIG. 1 is a block diagram of a preferred embodiment of the invention.

Referring now to FIG. 1, there is shown a block diagram representation of a digital time-division multiplex electronic organ system which may be of the type disclosed in copending application Ser. No. 561,970 filed on Mar. 26, 1975 in the name of James S. Southard and assigned to the same assignee as the present invention. The organ preferably includes keyboard and control switches 10, which may be of any suitable type for use with a time-division digital multiplex organ system. These keyboard and control switches provide outputs representative of the selective closures thereof on parallel output leads 11 to a multiplexer circuit 14 which may be of any suitable type.

The multiplexer circuit 14 is operated in response to clock pulses obtained from a clock pulse generator circuit 16, which preferably supplies square wave clock pulses at the desired scanning rate to the multiplexer 14. Under control of the clock pulses, the multiplexer 14 sequentially and repetitively scans the information on the leads 11 from the keyboard and control switches 10 to produce a time-division multiplexed signal containing a cyclically repeating sequence of time slots, each corresponding with a particular switch in the keyboard and control switch circuit 10. A pulse in a time slot is indicative of the actuation of the switch which corresponds with that time slot. This time-division multiplexed signal is applied from the output of the multiplex circuit 14 to the input of first and second signal channels, one including a shift register delay circuit 18 and the other including an inverter 19. The number of stages in the shift register circuit 18 is selected to be N times the number of time slots in each sequence of the time-division multiplex signal from the multiplex circuit 14 wherein N is a positive integer. As illustrated in FIG. 1, this is shown as N times 135 stages since 135 time slots are used in the signal of the above-mentioned copending application. Typically, N is 2, so that the shift register 18 has 270 stages in the example shown. It should be emphasized that the number of stages of the shift register circuit 18 indicated in FIG. 1 is illustrative only, since the actual number of stages depends directly upon the number of time slots in each sequence of the particular multiplex signal produced by the multiplexer circuit 14.

The output of the shift register 18 is supplied to one of two inputs of a NAND gate 21, and the other input to the NAND gate 21 is obtained from the output of the inverter 19. The output of the NAND gate 21 comprises a reconstructed multiplexed signal representative of a pizzicato touch in the operation of the keyboard and control switches 10 even though the keyboard of the organ may be played in a legato manner. This reconstructed time-division multiplexed signal is applied from the output of the NAND gate 21 to a percussion or chiff keyer 23, which then produces percussive and/or chiff tone effects in accordance with the time slots occupied by the pulses in the signal on the output of the gate 21. These tones are supplied on an output lead 24 for utilization in a conventional manner by the electronic organ.

The clock signal pulses which operate the multiplex circuit 14 and control the scanning rate of that circuit also are used to shift the shift register 18 in synchronism with the multiplexed signal. The same clock pulses are used to shift the information from the gate 21 into the keyer 23; so that at all points in the circuit, the digital time-division multiplexed signal is moved through the different circuits in synchronism with the scanning rate of the multiplex circuit 14. At the end of each repeating sequence of time slots of the multiplexed signal, a strobe pulse is produced by the multiplex circuit 14. This pulse is supplied over a lead 25 to cause the keyer circuit 23 to operate to produce in parallel the tones represented by pulses in the different time slots of the input signal sequence applied to the keyer 23.

Figure 2:
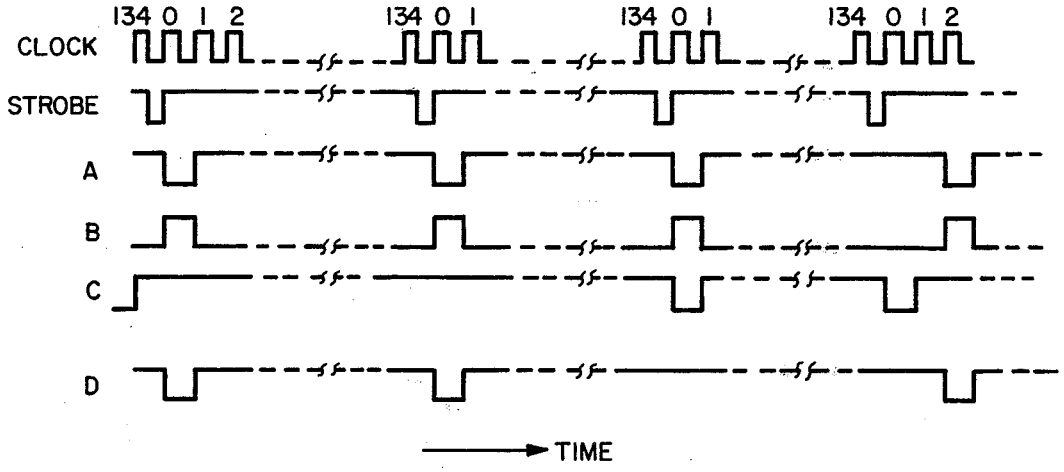
FIG. 2 illustrates pulse waveforms useful in explaining the operation of FIG. 1.

FIG. 2 illustrates the manner in which the shift register 18, inverter 19, and NAND gate 21 operate to reconstruct or alter the time-division multiplexed signal to a form which gives the effect of a single pizzicato strike effect when a key is depressed to close a key switch 10 even though the musician may be playing the key in a legato style.

In the operation of the circuit shown in FIG. 1, the square wave clock pulses supplied to the multiplex circuit 14, the shift register 18, and the keyer 23 are typically supplied at a 55 KHz rate; and these clock pulses are shown in the top line of the waveforms in FIG. 2. As stated previously, assume that the repeating sequence of time slots is 135 time slots or data pulses long, with the sequence continuing to repeat. In FIG. 2, the beginning and end portions of four such sequences are illustrated in the clock pulse waveform. Each sequence is shown broken in the middle to avoid unnecessary repetition of the large number of clock pulses in each sequence. During the last half of pulse no. 134 of each of these sequences, a negative strobe pulse is produced, as shown in the pulse waveform directly under the clock pulse waveform in FIG. 2. This is the pulse supplied on the lead 25 for strobing the keyer 23 to sample the data passing through it. The clock pulses and the strobe pulses always appear in the relationship illustrated in FIG. 2.

For the purpose of understanding the operation of the system, the serial data supplied from the output of the multiplex circuit 14 is indicated in waveform A of FIG. 2. To simplify this description, assume that only a single data pulse indicative of an operated key appears in the entire 135 bit time frame or time slot sequence, representative of only a single tone or note being played in the instrument. This pulse is shown in waveform A as appearing in time slot 0 for the first three repeating sequences. The pulse does not appear in time slot 0 for the fourth sequence, but a new pulse appears in time slot 2 of that sequence. This is indicative of the release of the note represented by a pulse in time slot 0 and the playing of the note represented by time slot 2 at some time between time slot 0 of the third sequence and time slot 2 of the fourth sequence.

When the first negative data pulse, as shown in the left-hand sequence of pulse waveform A, appears at the output of the multiplex circuit 14, it is inverted by the inverter 19 to the positive pulse shown in waveform B. The output of the shift register 18 is normally positive in the absence of any data pulse in the output stage. Since the first data pulse is applied to the input stage of the shift register 18, its output C is positive at this time of initial operation. As a consequence, both of the inputs to the NAND gate 21 are positive when the data pulse first appears in waveform A during the first sequence of time slots. Thus, a negative data output pulse is produced at the output of the NAND gate 21 in time slot 0, as shown in waveform D. This constitutes the beginning of percussion data supplied in that time interval to the percussion or chiff keyer 23.

The 55 KHz clock pulses applied to the multiplexer 14 and the shift register 18 shift this first data pulse on through the shift register 18; so that, for the shift register of this description with N equal to 2, the pulse appears in the middle of the shift register when the second multiplexed sequence of time slots is initiated. At the second sequence, assuming the same note is still held down, a negative pulse again appears in time slot 0 of waveform A, as illustrated in the second group of pulses from the left. This pulse is inverted by the inverter 19 to a positive pulse and again is passed by the NAND gate 21 as a second negative data output pulse in time slot 0 of waveform D supplied to the keyer 23. This pulse is processed in the keyer upon the application of a strobe pulse on the lead 25 to the keyer 23 to continue the duration of the percussion or chiff tone on the output lead 24 corresponding to a pulse in time slot 0.

At the beginning of the next or third multiplex time cycle, as shown in FIG. 2, if the same note continues to be held down, a negative data pulse again appears in time slot 0 at the output of the multiplex circuit 14 (waveform A). This pulse again is inverted by the inverter 19, as described previously; but this time the inverted pulse of waveform B arrives at the input of the NAND gate 21 simultaneously with the negative delayed pulse (waveform C) out of the shift register 18. Since one of the inputs to the NAND gate 21 now is negative, this prevents the output of the NAND gate 21 from going negative. Thus, no further data is obtained from the NAND gate 21 for time lost 0, so long as the key producing a data pulse in time slot 0 continues to be held down as represented by the output of the control and keyboard circuit 10. When the key for that particular note subsequently is released, the subsequent delayed negative output pulses for that time slot which are shifted out of the output stage of the shift register 18 have no effect, since the NAND gate 21 is not enabled by negative pulses.

When a data pulse in a given position reappears or appears in a different position, such as shown for time slot 2 in the fourth or right-hand sequence of time slots in waveform A of FIG. 2, the above sequence of operation is repeated. Thus, the longest duration of a percussion data pulse at the output of the NAND gate 21 is for two time period sequences of the multiplexed signal cycle, when the shaft register has twice the number of stages as the number of time slots in each sequence. If a longer duration of percussion pulses is desired, the number N for the shift register stages can be increased. If a lesser duration is desired, the minimum number of stages of the shift register 18 is equal to the number of time slots in a single sequence of the multiplexed signal.

When the system is operated at the 55 KHz clock frequency described, the desired pizzicato effect is produced by the percussion or chiff keyer 23. The system will produce this same effect for a shift register having a length of only 135 stages (a length equal to the number of time slots in one multiplex sequence), but two time frames of the multiplexer system operation are used as a safety factor to guarantee that the data shows up on the output of the percussion processor in response to the playing of a key or keys by the musician.

The system which has been described requires a minimum number of components to produce chiff or percussion effects from a keyboard played in a legato manner. The system also may be readily implemented into a time-division multiplexed signal processing system for an electronic musical instrument.

I claim:

1. In an electronic musical instrument, wherein information representative of the actuation of selected switches corresponding to associated notes of the musical scale is furnished by a multiplex circuit in the form of a time-division multiplexed signal including a cyclically repeating sequence of time slots associated respectively with such switches, and in which a pulse in a time slot is indicative of the actuation of the switch associated with that time slot, a processing circuit including in combination:

first and second signal channels;

delay circuit means in said first signal channel having a delay period equal to N sequences of time slots, where N is a positive integer;

inverter circuit means in one of said signal channels;

means for supplying said multiplexed signal to the inputs of said first and second signal channels;

coincidence gate means with first and second inputs, the first input coupled with the output of said first signal channel and the second input coupled with the output of said second signal channel, for passing pulses in time slots of said time-division multiplexed signal only when a predetermined relationship of the signals applied to the first and second inputs thereof exists.

2. The combination according to claim 1, wherein said delay circuit means comprises a shift register circuit shifted at the pulse rate of said multiplexed signal and having a number of stages equal to the number of time slots in N sequences of time slots.

3. The combination according to claim 2, wherein said means for supplying said multiplexed signal comprises a digital multiplex generator, and further including clock generator circuit means for supplying clock pulses to said multiplex generator and to said shift register circuit for advancing the same in synchronism with one another.

4. The combination according to claim 3, further including means coupled with the output of said coincidence gate means for producing tones corresponding to the respective notes represented by the pulses at the output of said coincidence gate means for a duration proportional to the number of times each such pulse appears in corresponding time slots of consecutive sequences of time slots in said multiplex signal at the output of said coincidence gate means.

5. The combination according to claim 2, wherein said inverter circuit means is in said second signal channel and said coincidence gate means comprises a NAND gate, a pulse in a time slot indicative of the actuation of a switch comprises a negative data pulse, said shift register circuit normally producing a positive output in the absence of the application to the input thereof of a negative data pulse, so that said NAND gate produces a negative pulse at its output only when the output of said shift register is positive and the output of said inverter circuit means is simultaneously positive.

* * * * *